US010172202B2

(12) United States Patent
Claessens et al.

(10) Patent No.: US 10,172,202 B2
(45) Date of Patent: Jan. 1, 2019

(54) CIRCUIT ARRANGEMENT FOR CONTROLLING A LED UNIT AND METHOD OF OPERATING THE SAME

(75) Inventors: Dennis Johannes Antonius Claessens, Eindhoven (NL); Jascha Van Pommeren, Utrecht (NL); Jan Wojciech Obrebski, Eindhoven (NL); Yi Wang, Delft (NL); Philip Louis Zulma Vael, Temse (BE); Sait Izmit, Utrecht (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 77 days.

(21) Appl. No.: 14/241,489

(22) PCT Filed: Aug. 29, 2012

(86) PCT No.: PCT/IB2012/054439

§ 371 (c)(1),
(2), (4) Date: Apr. 8, 2015

(87) PCT Pub. No.: WO2013/035018

PCT Pub. Date: Mar. 14, 2013

(65) Prior Publication Data

US 2016/0044756 A1 Feb. 11, 2016

Related U.S. Application Data

(60) Provisional application No. 61/532,130, filed on Sep. 8, 2011, provisional application No. 61/532,162, filed on Sep. 8, 2011.

(30) Foreign Application Priority Data

Sep. 8, 2011 (EP) ..... 11180632

(51) Int. Cl.
*H05B 33/08* (2006.01)

(52) U.S. Cl.
CPC ..... *H05B 33/0845* (2013.01); *H05B 33/0809* (2013.01); *H05B 33/0842* (2013.01)

(58) Field of Classification Search
CPC ..... H05B 33/0845; H05B 33/0809; H05B 33/0842; H05B 37/02; H05B 41/2828; H05B 41/3925; H02M 1/08; Y02B 20/19
(Continued)

(56) References Cited

U.S. PATENT DOCUMENTS 5,559,395 A 9/1996 Venkitasubrahmanian et al.
6,472,945 B1 * 10/2002 Gumm ..... H03B 5/24 331/138

(Continued)

FOREIGN PATENT DOCUMENTS

JP 2013026079 A 2/2013

*Primary Examiner* — Alexander H Taningco
*Assistant Examiner* — Renan Luque
(74) *Attorney, Agent, or Firm* — Akarsh P. Belagodu

(57) ABSTRACT

A circuit arrangement for controlling the brightness of at least one LED unit is described by the disclosure. The circuit arrangement, in one example, includes an input for receiving a phase-cut operating voltage from a power supply, a signal processor, connected with the input and adapted to provide a dimming signal for the at least one LED unit from the operating voltage. To allow an efficient reduction of noise in the dimming signal but simultaneously to allow an improved dimming of the LED unit, the signal processor are configured to operate at least in a noise suppression mode and a dimming mode. A control device is provided, connected with the signal processor and configured to set the mode of the signal processor in dependence of the variation in the operating voltage.

14 Claims, 5 Drawing Sheets

(58) Field of Classification Search
USPC ... 315/200 R, 224, 291, 307, 246, 294, 297, 315/149, 185 R, 201, 206, 209 R, 210, 315/250; 323/311; 327/407
See application file for complete search history.

(56) References Cited

U.S. PATENT DOCUMENTS

| | | | | |
|---|---|---|---|---|
| 2003/0080696 | A1 | 5/2003 | Tang et al. | |
| 2008/0224633 | A1 | 9/2008 | Melanson et al. | |
| 2009/0160369 | A1 | 6/2009 | Godbole et al. | |
| 2009/0167203 | A1 | 7/2009 | Dahlman et al. | |
| 2010/0090618 | A1 | 4/2010 | Veltman | |
| 2010/0123410 | A1 | 5/2010 | Tsai | |
| 2010/0213870 | A1 | 8/2010 | Koolen | |
| 2011/0037418 | A1* | 2/2011 | Park ..... | H05B 33/0815 315/307 |
| 2011/0057564 | A1 | 3/2011 | Otake | |
| 2011/0084622 | A1 | 4/2011 | Barrow et al. | |
| 2012/0286681 | A1* | 11/2012 | Hausman, Jr. ..... | H05B 41/2828 315/200 R |
| 2012/0286689 | A1* | 11/2012 | Newman, Jr. ..... | H05B 41/2828 315/246 |

* cited by examiner

CIRCUIT ARRANGEMENT FOR CONTROLLING A LED UNIT AND METHOD OF OPERATING THE SAME

TECHNICAL FIELD

The present invention relates to the field of lighting and in particular to a circuit arrangement for controlling the brightness of at least one LED unit, a LED lamp comprising a corresponding circuit arrangement and a method of brightness control of at least one LED unit.

BACKGROUND ART

In the field of lighting, incandescent or halogen lamps are being replaced today by LED lamps. The low power consumption and long lifetime make them a very useful alternative to the above mentioned conventional light sources. In addition to the use of such LED lamps in new-designed lighting equipment, a particular need exists to retrofit existing lighting systems with LED lamps and thus to replace the above mentioned common types of lamps.

In the before mentioned retrofit application, it is typically necessary to adapt the LED lamp to the respective lighting system installed to allow proper operation, since a change in the setup or wiring of the respective lighting system to be retrofitted, for example installed in an office building, is not easily possible and would result in substantially increased cost of the retrofit process.

A particular example for the above mentioned retrofit application is the replacement of common halogen type lamps in a low-voltage lighting system. Such lighting systems typically comprise a transformer to provide a voltage of e.g. 12V AC. In particular in such lighting systems, various types of dimmers, such as electronic dimmers are employed, operating on the basis of phase cutting, i.e. an adaptation of the RMS voltage according to the desired dimming or brightness level.

While according phase-cut dimmers allow a dimmed operation of a common type of lamp, a reduction of the RMS voltage supplied to an LED lamp does not allow to efficiently dim the LEDs, because of the exponential voltage behavior of LEDs. Instead, the dim or brightness level of LED lamps is typically set by adjusting the current through the LED, e.g. using a current controllable driver unit.

Depending on the lighting system to be retrofitted, it may be useful to allow a dimmed operation according to the brightness or dim level, set by a user using the installed phase-cut dimmer. When retrofitting such lighting system, the desired dim level thus needs to be "extracted" from the operating voltage to allow an accordingly dimmed operating of the LED lamp.

However, noise is caused in the operating voltage by the switching behavior of the above-mentioned phase-cut dimmer, but also due to the switching operation in typically employed electronic transformers. The noise is typically increased due to the fact that LED lamps use considerably less power than conventional lamps, so that the under-load of the dimmer or, in low-voltage systems the dimmer-transformer combination can cause the output of the dimmer to be slightly unstable.

Accordingly, when using the operating voltage to set the current of the LED in an LED lamp, the comprised noise may cause substantial flicker in the output light, visible to the human eye. In particular in the frequency range of 0.1-100 Hz, sometimes even variations in the light output of <1% can be noticed by the human eye and are thus considered disturbing.

Accordingly, it is an object of the present invention to provide a circuit arrangement for an improved control of the brightness of at least one LED to provide a substantially flicker-free light output.

DISCLOSURE OF INVENTION

The object is solved by a circuit for controlling the brightness of at least one LED unit, an LED lamp, a lighting system and a method of controlling the brightness of at least one LED unit according to the instant disclosure.

The basic idea of the present invention is to provide a signal processor, configured to provide a dimming signal for a LED unit from a phase-cut operating voltage in a noise suppression mode and a dimming mode. The dimming signal may be provided as a current-setpoint signal to a LED driver.

The invention is based on the finding that noise suppression, i.e. using a low-pass filter, typically causes a substantial phase-shift or time lag, so that in case of a user operation, i.e. a change of the dim/brightness setting of a phase-cut dimmer of a corresponding power supply, the brightness of the LED follows the changed dim setting only slowly. In certain applications, this may be unacceptable. Accordingly, the invention proposes to operate said signal processor in said noise suppression mode and said dimming mode, to on one hand allow a quick reaction of the LED brightness in case of a user operation, i.e. a change of the dim/brightness setting of a phase-cut dimmer by a user, and on the other hand to reduce noise, comprised in said operating voltage. The mode of said signal processor is set in dependence of the variation in said operating voltage, which has been surprisingly found to be an indication of said user operation.

The present invention thus advantageously allows an improved dimming operation of an LED unit, while providing a substantially flicker-free light output.

The inventive circuit arrangement for controlling the brightness of said at least one LED unit comprises an input for receiving a phase-cut operating voltage from a power supply. The signal processor is connected with said input and adapted to provide said dimming signal for said at least one LED unit from said phase-cut operating voltage. The signal processor is configured to operate at least in said noise suppression mode and said dimming mode. Furthermore, the inventive circuit comprises a control device, connected with said signal processor and being configured set the mode of said signal processor in dependence of the variation of said operating voltage.

As discussed above, the inventive circuit comprises at least an input for receiving the phase-cut operating voltage from the power supply, such as a low-voltage power supply. The input may be of any suitable type to allow a permanent or detachable connection to the power supply and e.g. comprise two electric terminals, such as connecting pins, solder pads or any other suitable connector or plug to allow a corresponding electrical connection at least during operation. The input may certainly comprise further components or circuits. For example, the input may e.g. comprise a rectifier for providing a unipolar phase-cut operating voltage to the signal processor. Corresponding rectifiers are full-wave bridge rectifier for example.

According to the invention, the input is adapted for receiving said phase-cut operating voltage from a power supply, which operating voltage basically is a sinusoidal voltage with a part of each wave (or usually each half wave), chopped or cut out. In case of a low-voltage power supply having an electronic transformer, the voltage may comprise a high-frequency oscillation. Here, the phase-cut sine wave may form the envelope of said high-frequency oscillation.

Although the phase-cut power supply in this context usually comprises a "dimmer", e.g. a phase-cut dimmer, sometimes also referred to as "phase firing controller", in the sense that part of the wave (or the envelope, respectively) is chopped, any phase-cut technology used in the art may be employed.

Corresponding types of phase-cut dimmers are adapted to reduce the RMS value of the voltage and thus the power, transferred to the lamp, by switching off the power supply to the load for a given time in each half cycle of an alternating voltage, wherein the timing ratio of the "on" and "off"-time corresponds to the dim level, set by the user. Accordingly, said phase-cut operating voltage inherently comprises dim information corresponding to the dim or brightness setting of the user.

The power supply may e.g. be of AC mains type or of low-voltage type, comprising an electric, e.g. magnetic, or electronic transformer. In each case however, a device for phase-cut operating is present.

The operating voltage may in general correspond to an alternating voltage, e.g. a sinusoidal voltage, such as an AC voltage from a 110 V or 220 V mains connection. It is however preferred, that the operating voltage is a safety-low voltage, i.e. equal to or less than 42 V, most preferred equal to or less than 25 V or 14 V. The power supply may thus correspond to a low-voltage power supply.

As discussed above, the signal processor is connected with said input, e.g. over a suitable electrical connection either direct or over intermediate components, such as a filter as discussed below. The signal processor is further adapted to provide a dimming signal for said at least one LED unit from said phase-cut operating voltage. The signal processor may thus be connected with an output for connection with said at least one LED unit, e.g. using a suitable permanent or detachable electrical connection. The output in this case may comprise at least one corresponding electrical terminal, such as a connecting pin, solder pad or any other suitable connector or plug to allow an electrical connection at least during operation. The LED unit may be of any suitable type and comprise at least one light emitting diode (LED), which in terms of the present invention, may be any type of solid state light source, such as an inorganic LED, organic LED or a solid state laser, e.g. a laser diode. The LED unit may certainly comprise more than one of the before mentioned components, connected in series and/or in parallel. For general lighting applications, the LED unit may preferably be a mid-power LED unit with a nominal power consumption between 0.1-1 W. Most preferably, the LED unit is a high-power LED unit, i.e. having a nominal power consumption of more than 1 W, i.e. in a not dimmed state, for which the inventive circuit is particularly advantageous. The LED unit may certainly comprise further electronic circuitry, such as e.g. a driver unit, to set the current through the respective LEDs according to the dimming signal of said signal processor.

As discussed above, the signal processor according to the invention is configured to provide a dimming signal from said operating voltage and furthermore to operate at least in said noise suppression mode and said dimming mode. The signal processor may be of any suitable type to allow the above operation and may be implemented using an analog and/or digital setup. The signal processor may e.g. comprise discrete or integrated electronic circuitry, a microcontroller and/or a computing device. The signal processor may in addition comprise a suitable programming to provide the above functionality.

The dimming signal may be of any suitable type to allow setting the brightness of said LED unit. Preferably, the voltage amplitude of said dimming signal corresponds to the respective dim setting. The term "corresponds" includes a linear/non-linear scaling factor between dim setting and dimming signal. The dimming signal may be generated from said operating voltage by said signal processor according to a predefined processing. In said noise suppression mode, the signal processor may provide filtering of the operating voltage, so that noise or ripple, present in said operating voltage, is removed or at least substantially reduced from said dimming signal, compared to said operating voltage.

In the context of the present invention, the term "noise" or "noise signal" with reference to the operating voltage refers to a random and/or periodic amplitude fluctuation or ripple of the operating voltage, which, as discussed above, is typically caused by the switching operation of said power supply and may cause flicker in the light output of said LED unit. In particular, noise in the present context may refer to a random fluctuation within a frequency range of 0.01 Hz to some MHz.

The operation of said signal processor in said dimming mode differs from the operation in the noise suppression mode in the processing of the operating voltage to generate said dimming signal. For example, the signal processor in said dimming mode may be configured with a reduced phase shift or time constant/lag, so that the dimming signal "follows" variations in said operating voltage quickly, e.g. caused by a change of the dim setting of the phase-cut dimmer by a user. Preferably, the phase shift in said dimming mode is lower than the phase shift in said noise suppression mode. Therefore, the signal processor may also be referred to as a controllable filter device. Certainly, the signal processor may be configured to operate in more than the before mentioned two modes.

As discussed above, the mode of said signal processor according to the invention is set by the control device. The control device is accordingly wired or wireless connected with the signal processor and configured to control the mode of said signal processor in dependence of the variation in said operating voltage, i.e. the change in the RMS amplitude value of said phase-cut operating voltage in a given time interval. As discussed above, the present inventors have surprisingly found that the variation of the operating voltage is an indication of said user operation. When the dim setting of the phase-cut dimmer is changed by a user, a relatively high variation in the operating voltage is present. Preferably, the control device therefore is configured to set the mode of the signal processor to the dimming mode in case a high variation in said operating voltage is determined.

Advantageously, the dimming signal then "follows" or corresponds to the changed dim setting without a large time lag, so that the brightness of the LED unit is changed quickly after a user operation, thus providing a transparent control and thus enhanced a user experience.

The control device may be of any suitable type to allow determining said variation of the operating voltage and to control the signal processor in accordance with the determined variation. The control device may be formed as a separate circuit or component or may be integrated with further components of the inventive circuit. Preferably, the control device is formed integrally with said signal processor. To determine the variation in said operating voltage, the control device may be suitably connected with the input, the signal processor and/or the output, i.e. to receive a signal, corresponding to the operating voltage and/or the dimming signal.

According to a development of the invention, the control device is further configured to set the signal processor to said dimming mode in case the variation in said operating voltage is higher than a predefined threshold value.

The present development advantageously provides that said signal processor is set to the dimming mode in case a relatively high variation in said operating voltage is determined, such as in the case of a user operation, i.e. a change of the dim setting by controlling the phase-cut dimmer of said power supply. When no user operation is determined, i.e. in case the variation of said operating voltage is equal to or below said predefined threshold value, the control device preferably sets the signal processor to said noise suppression mode to efficiently filter noise, comprised in said operating voltage.

The threshold value may be chosen in dependence of the respective application and in particular in dependence of typical noise amplitudes of the respective power supply used. Preferably, the threshold value may be less than 1.5 V; most preferably less than 1 V.

According to a further development of the invention, the control device is configured to determine said variation by comparing the operating voltage with a reference signal. The reference signal may be of any suitable type to allow a comparison with the operating voltage. Preferably, the control device is configured to compare the amplitude or the RMS amplitude value of the operating voltage with the amplitude or RMS amplitude value of the reference signal.

Most preferably, the reference signal corresponds to the dimming signal. According to the present embodiment, the operating voltage, i.e. the input signal of the signal processor is correspondingly compared with its output signal, i.e. the dimming signal.

The present embodiment is based on the recognition that in case the operating voltage changes suddenly, a voltage may be present between the operating voltage and the dimming signal, so that a variation in said operating voltage can e.g. be determined by a measurement of the corresponding voltage. The embodiment thus allows a reliable determination of said variation in said operating voltage while allowing a simple and cost-efficient setup of the control device.

To further improve the light output of the at least one LED unit, it is preferred that a first low-pass filter is connected between said input and said signal processor, i.e. to provide a pre-filtered operating voltage from said phase-cut operating voltage. The present embodiment provides that the operating voltage is pre-filtered before it is further processed by the signal processor to obtain said dimming signal. The signal processor accordingly is connected with said filter so that said dimming signal is provided from the pre-filtered operating voltage. The embodiment advantageously provides that a substantial part of the noise, comprised in the phase-cut operating voltage, e.g. the before mentioned high-frequency oscillation of an electronic transformer, is filtered out before the further processing of the signal processor, which enhances the operation of said signal processor and thus the overall circuit.

The low-pass filter may be of any suitable type, such as for example a RC low-pass filter circuit. The cut-off frequency of said first low-pass filter device may be chosen in accordance with the application; preferably, the cut-off frequency of said first low-pass filter device is between 1 Hz and 20 Hz. Most preferably, the cut-off frequency is between 10 Hz and 20 Hz.

According to a further preferred embodiment of the invention, the signal processor comprises a second low-pass filter to provide said dimming signal from said operating voltage. The second low-pass filter is operated in said noise suppression mode with a first cut-off frequency and in said dimming mode with a second cut-off frequency, wherein the first cut-off frequency is lower than said second cut-off frequency. The present embodiment thus provides low-pass filtering of said operating voltage with a controllable cut-off frequency.

The mentioned relatively low first cut-off frequency in said noise suppression mode advantageously provides that even low-frequency noise, e.g. in the range of 0.1-5 Hz is attenuated so that flicker of said at least one LED unit during operation is reduced. The relatively high second cut-off frequency in said dimming mode allows the dimming signal to correspond with a user operation instantly, since an increased cut-off frequency typically results in decreased phase shift or time lag of a corresponding low-pass filter. The present embodiment thus allows the brightness of said at least one LED unit to "follow" said dim information immediately upon a user operation, while simultaneously providing that also low-frequency noise is substantially reduced.

The second low-pass filter as described above is particularly advantageous in combination with the above pre-filtering, i.e. the first low-pass filter. However, the invention may certainly be operated according to an embodiment, using only the above mentioned second low-pass filter of said signal processor without the provision of a pre-filtering, i.e. without said first low-pass filter.

The first and second cut-off frequencies may be chosen according to the application and in correspondence with the respective power supply used. The first cut-off frequency should be as low as possible. Preferably, the first cut-off frequency is 0.1 Hz or lower. The second cut-off frequency may be chosen by the required dimmer response speed, where a higher cut-off frequency results in a decreased time lag, as mentioned above. Preferably, the second cut-off frequency is equal to or higher than 20 Hz. In case the before-mentioned first low-pass filter is present, the second cut-off frequency is most preferably higher than the cut-off frequency of said first low-pass filter, which would render the second low-pass filter inactive.

Preferably, the first cut-off frequency corresponds to less than ⅕ of the second cut-off frequency, i.e. the second cut-off frequency is preferably at least five times greater than said first cut-off frequency. The second low-pass filter device may be of any suitable type to allow the above operation, preferably however, the second low-pass filter is an RC low-pass filter circuit, e.g. comprising at least a resistive and a capacitive path to provide a cost efficient setup of the signal processor. The resistive and capacitive paths may comprise a resistive and capacitive element, respectively, which may be provided as discrete components or integrated circuitry.

Most preferably, the control device comprises a switchable control circuit. The control circuit is connected in parallel to said resistive path of said RC filter circuit. The control circuit provides a switchable alternative current path to allow a control of the cut-off frequency of said RC filter circuit. Since the cut-off frequency $f_c$ of a RC filter circuit is given by $$f_c = \frac{1}{2\pi RC},$$

the control circuit allows to set the cut-off frequency of the RC filter circuit by modifying the resistor value which according to the above formula, influences the cut-off frequency. The control circuit may comprise a switching device in series with a second resistive element to set the resistor value of the RC filter circuit. Accordingly, by controlling the switching device it is possible to set the RC filter circuit of said signal processor to said first and second cut-off frequency, respectively and thus the signal processor to said noise suppression mode and said dimming mode, respectively.

The switching device may be of any suitable type to control the current flow through said control circuit. The second resisting element of said control circuit may be provided as a simple resistor. Alternatively, the resisting element may be formed by any suitable electrical component, providing a defined electric resistance to provide the desired cut-off frequency of the RC low-pass filter circuit. Preferably, the switching device is a diode arrangement, comprising at least one diode. Most preferably, the switching device comprises at least two diodes, arranged parallel to and opposing each other.

According to a further preferred embodiment of the invention, the control circuit comprises a delay unit, adapted to receive said phase-cut operating voltage and to provide said reference signal, corresponding to said operating voltage with a predefined delay time.

As discussed above, the control device may be adapted to determine the variation in said operating voltage by comparing said operating voltage with said reference signal. According to the present embodiment, the reference signal corresponds to the operating voltage, however delayed by a pre-defined delay time. Accordingly, it is possible to determine a variation in said operating voltage by comparing the two signals, i.e. by comparing the present amplitude of said operating voltage with a previous amplitude and thus the gradient of the operating voltage. Certainly, in case the first low-pass filter is connected between said input and said signal processor, the delay unit is adapted to receive the pre-filtered operating voltage from said low-pass filter.

The delay unit may be of any suitable type to provide the discussed delay of the operating voltage and may comprise discrete and/or integrated electronic circuitry. For example, the delay unit may be implemented using one or more counters and/or a microprocessor. The predefined delay time may be set according to the application, preferably, the delay time is set to 0.1-5 seconds, most preferably to less than 1 second.

Preferably, the signal processor comprises a controllable sampling circuit, which is adapted upon activation to sample an amplitude of said dimming signal, so that said dimming signal corresponds to said sampled amplitude until said sampling circuit is deactivated.

According to the present embodiment, the signal processor is adapted to sample or freeze the amplitude of said dimming signal, when said sampling circuit is in its activated state. The operation of the signal processor in the present embodiment thus corresponds to the operation of a sample and hold circuit. The sampling circuit may be of any type; preferably, the sampling circuit is an integrated circuit, such as a microcontroller with a suitable programming.

Preferably, the signal processor is configured so that said sampling circuit is activated in said noise suppression mode. Accordingly, the dimming signal is substantially maintained constant at the sampled amplitude. The present embodiment accordingly allows a particularly advantageous suppression of noise, since in said noise suppression mode, i.e. when no user operation is determined, the dimming signal is held at the amplitude level, set by the user previously. Noise in said operating voltage is not transmitted by the signal processor to the dimming signal and is thus suppressed.

Most preferably, the signal processor is configured so that said sampling circuit is deactivated in said dimming mode. Accordingly, the dimming signal then corresponds to the dim level, set by the user, i.e. the operating voltage or the pre-filtered operating voltage, respectively.

In a development of the invention, the sampling circuit comprises an output delay unit, adapted to receive the dimming signal and to provide a delayed dimming signal to a controllable switching device. The switching device according to the present embodiment is adapted in the dimming mode to set said dimming signal to said operating voltage. In the noise suppression mode, the dimming signal is set to said delayed dimming signal.

Corresponding with the above, in case the switching device is set to said noise suppression mode, the dimming signal is held or frozen to said sampled amplitude, since the dimming signal is set to its previous value and thus maintained substantially constant.

According to a preferred embodiment of the invention, the circuit arrangement further comprises a driver unit, connected with said input and adapted to provide an operating current to said at least one LED unit. The driver unit is further connected with said signal processor to set the operating current corresponding to said dimming signal.

As discussed above, the driver unit is connected with said input to provide an operating current to said at least one LED unit according to said dimming signal. Correspondingly, the brightness of said at least one LED unit is set according to the dimming signal. The driver unit thus provides the functionality of a controllable current source, controlled by said dimming signal. The driver unit may be setup using a buck converter, e.g.

According to a second aspect of the invention, a LED lamp is provided, comprising at least one circuit arrangement and one or more LED units as described above. Preferably, said LED units are connected with said driver unit, so that the operating current of said LED units is controlled according to the dimming signal and thus the dim/brightness level, desired by the user.

According to a further aspect of the invention, a lighting system is provided comprising a LED lamp as described above and a phase-cut power supply, connected with the input of said circuit arrangement. The power supply provides a phase-cut operating voltage, as discussed above, and may e.g. comprise a corresponding phase-cut dimmer.

In an inventive method of controlling the brightness of at least one LED unit with a circuit arrangement comprising an input for receiving a phase-cut operating voltage from a power supply and a signal processor, connected with said input and being adapted to provide a dimming signal from said operating voltage, said signal processor being operable in at least a noise suppression mode and a dimming mode, the mode of said signal processor is set in dependence of the variation in said operating voltage.

BRIEF DESCRIPTION OF THE DRAWINGS

These and other aspects are features and advantageous of the present invention will be apparent from and elucidated with reference to the description of preferred embodiments, in which:

FIGS. 5*a* and 5*b* show schematic graphs of a dimming operation of a phase-cut-dimmer and a corresponding dimming signal.

DESCRIPTION OF EMBODIMENTS

Figure 1:
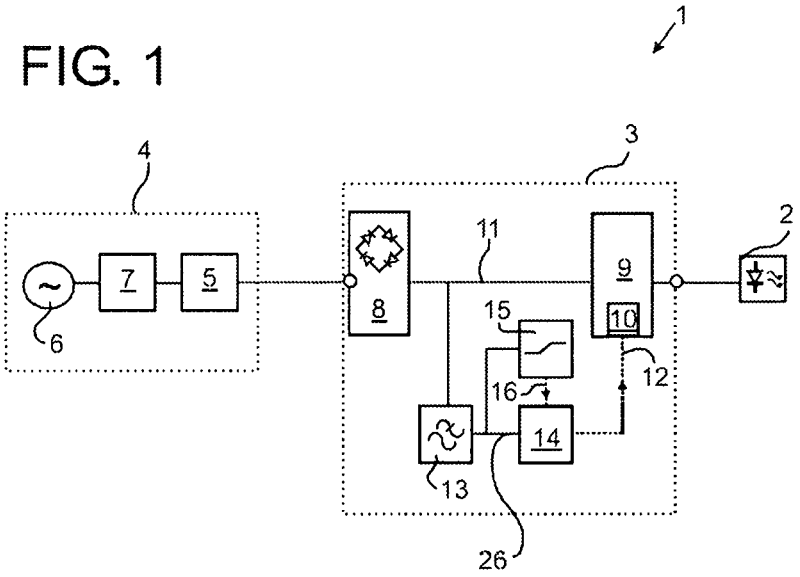
FIG. 1 shows a schematic block diagram of an embodiment of a lighting system comprising a LED lamp with a circuit arrangement for controlling the brightness thereof, connected to a phase-cut power supply.

FIG. 1 shows an embodiment of a lighting system comprising an LED lamp 1 in a schematic block diagram. The LED lamp 1 comprises a LED unit 2, connected with a circuit arrangement 3 for controlling the brightness of the LED unit 2. The LED lamp 1 is connected with a low-voltage power supply 4, which, according to the present embodiment, corresponds to a 12 V power supply of a typical halogen lighting system. The power supply 4 comprises an electronic transformer 5, which is connected with a mains line 6 over a phase-cut dimmer 7. The power supply thus provides a 12 V AC phase-cut operating voltage to the circuit arrangement 3, i.e. a sinusoidal voltage, where a part of each half wave is chopped or cut out. The operating voltage thus comprises inherent dim information according to the dim/brightness setting of the phase-cut dimmer 7, e.g. as controlled by a user with a corresponding wall-mounted knob.

The circuit arrangement 3 according to the present embodiment allows to operate the LED unit 2 with the low-voltage power supply 4, e.g. to retrofit a common 12V halogen lamp. In addition to providing power to the LED unit 2, the circuit arrangement 3 also provides an extraction of the dim information, comprised in said phase-cut operating voltage and to set the current of the LED unit 2 according to the determined dim information, which will be explained in detail in the following.

The circuit arrangement 3 comprises an input 8, connected with the power supply 4 to receive the alternating, phase-cut 12 V voltage. The input 8 comprises a G4 type plug (not shown) to allow a separable connection from the power supply 4. Furthermore, the input 8 comprises a full-wave bridge rectifier, to provide the further components of the circuit arrangement 3 and the LED unit 2 with a rectified, unipolar 12 V operating voltage on a supply line 11. A driver unit 9 is connected with the input 8 to power the LED unit 2, i.e. to provide a defined current to the LED unit 2. The driver unit 9 comprises a control port 10 to receive a dimming signal 12, i.e. a voltage, according to which the current to the LED unit 2 is set by the driver unit 9. The driver unit 9 thus corresponds to the setup of a controllable current source, and may e.g. comprise a buck converter.

Although not shown in FIG. 1, the driver unit 9 is connected with the LED unit 2 over a standard lamp socket connection, in the present example a G4 type socket. The LED unit 2 in the present example comprises a series connection of four high-power semiconductor light emitting diodes (not shown), each providing a luminous flux of more than 10 lm under nominal operating conditions.

When the power supply 4 is operated with the LED lamp 1, it may be desirable that dimming of the LED lamp 1 is possible upon manipulation of the dim setting of the phase-cut dimmer 7, e.g. by a user turning the corresponding dimmer knob. While the operation of the phase-cut dimmer 7 allows to instantly dim a common type of lamp, such as a halogen lamp, such control is not easily possible when using LEDs. Here, the current through the LEDs has to be set, e.g. by providing the dimming signal 12 to the driver unit 9. As mentioned above, the circuit arrangement 3 provides to extract the dim information, comprised in the operating voltage and to provide the corresponding dimming signal 12.

Figure 3:
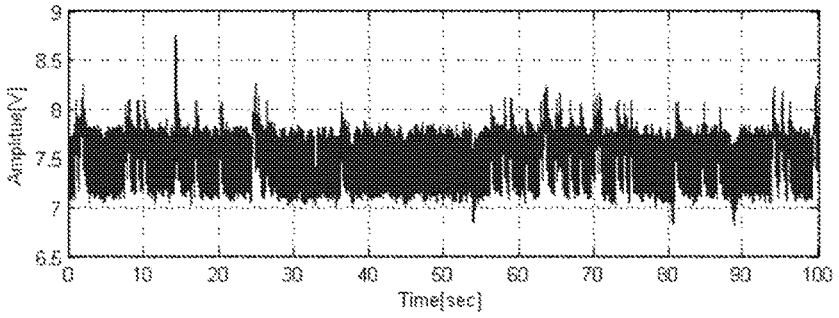
FIG. 3 shows an example of an operating voltage comprising a noise signal.

Problematic in this regard is that the operating voltage, supplied to the LED lamp 1 by the power supply 4 may comprise a relatively high noise signal, caused by transformer instabilities, dimmer instabilities and further dimmer-transformer interactions. A corresponding graph, showing the operating voltage after rectification and filtering by a first low-pass filter 13, is shown in FIG. 3. As can be seen from the FIG. 3, the operating voltage comprises noise with an average amplitude of approximately 1 V.

To avoid, that the noise signal, comprised in the phase-cut operating voltage provides flicker in the light output of the LED unit 2 when controlling the brightness of the LED unit 2 according to dim information of said phase-cut operating voltage, the present embodiments provides filtering of the operating voltage to obtain the dimming signal 12. The dimming signal 12 is then provided to the control port 10 of the driver unit 9 to accordingly set the current through the LED unit 2, as mentioned above.

As can be seen from FIG. 1, the circuit arrangement 3 according to the present embodiment shows a filter stage comprising said first low-pass filter 13 and a controllable signal processor 14. The first low-pass filter 13 is connected with the input 8 to receive the rectified operating voltage. The filter 13 provides pre-filtering of the rectified operating voltage, so that high-frequency noise, caused by the switching operation of the electronic transformer 5, is substantially reduced. According to the present embodiment, the first low-pass filter 13 is a second order low-pass RC filter with a cut-off frequency of 5-20 Hz.

The pre-filtered operating voltage 26 is then supplied to the signal processor 14, which is adapted to provide the dimming signal 12 from the pre-filtered operating voltage 26. The signal processor 14 is operable at least in a noise suppression mode 30 and a dimming mode 31, which mode is set by a control device 15. The control device 15 sets the mode of the signal processor 14 over a control connection 16 and in dependence of the variation in the operating voltage, i.e. as shown in the pre-filtered operating voltage 26.

In the noise suppression mode 30, the signal processor 14 is configured to provide filtering of the operating voltage, so that noise or ripple, as shown in FIG. 3, is removed or at least substantially attenuated. In the dimming mode 31, the signal processor 14 is configured with a reduced time lag, so that the dimming signal 12 follows variations in the operating voltage 26, and thus a user operation of the phase-cut dimmer 7, immediately.

Figure 2:
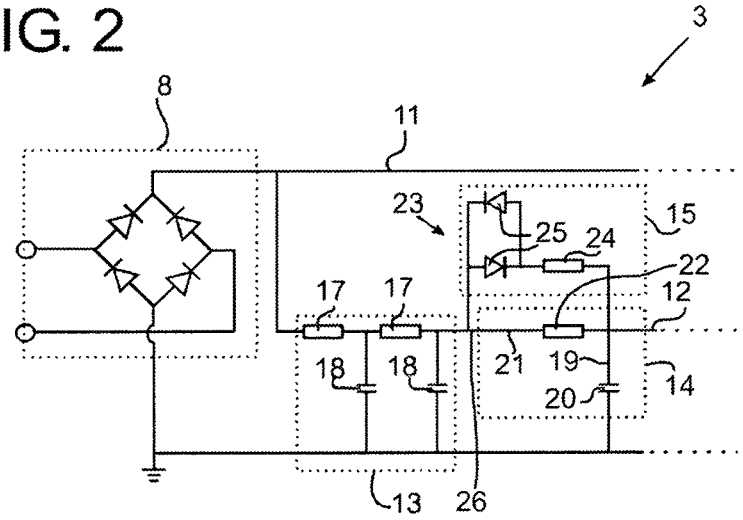
FIG. 2 shows a schematic circuit diagram of the circuit arrangement according to the embodiment of FIG. 1.

FIG. 2 shows a detailed circuit diagram of the circuit arrangement 3 according to FIG. 1. For reasons of clarity, some of the components discussed above have been omitted here.

As can be seen from FIG. 2, the input 8 comprises a full wave bridge rectifier to provide the unipolar operating voltage on supply line 11, as discussed above. The first low-pass filter 13 comprises two RC filter circuits, each comprising a resistor 17 and a capacitor 18. The corresponding filter circuits are provided for second order low-pass filtering of the rectified operating voltage with a cut-off frequency of 5-20 Hz.

The signal processor 14 comprises a second RC low-pass filter circuit, as can be seen from FIG. 2. The second RC low-pass filter circuit comprises a capacitive path 19 comprising a corresponding capacitor 20. A resistive path 21 is provided with a corresponding first resistor 22, so that the RC low-pass filter circuit shows a first cut-off frequency of approximately 0.1 Hz. As will become apparent from FIG. 2, parallel to the resistive path 21 a control circuit 23 is arranged comprising a second resistor 24 in series with a diode arrangement of two parallel connected opposing diodes 25.

Accordingly, when the diodes of the control device 15 are brought to a conductive state, the control circuit 23 provides an alternative current path through the second resistor 24, so that the cut-off frequency of the signal processor 14 is set to a second cut-off frequency, which second cut-off frequency according to the present embodiment is larger than 20 Hz, e.g. 50 Hz, thus higher than said first cut-off frequency. The thus generated dimming signal 12 is then provided to the control port 10 of the driver unit 9 (not shown in FIG. 2).

The operation of the circuit arrangement 3 according to FIG. 2 will hereinafter be explained in detail with reference to FIGS. 4-5. The rectified operating voltage is provided over supply line 11 to the first low-pass filter 13. The thus pre-filtered operating voltage 26 as shown in FIG. 4*b* is provided to the second low-pass filter of the controllable signal processor 14. Under normal operating conditions, i.e. when only noise is present in the operating voltage, the signal processor 14 is set to the first cut-off frequency in said noise suppression mode 30, which results from the operation of first resistor 22 and capacitor 20. In case of a relatively high variation in the operating voltage in the dimming mode 31, a voltage is present between the pre-filtered operating voltage 26, i.e. at the output of first low-pass filter 13, and output of the signal processor 14, i.e. the dimming signal 12. When the corresponding voltage is higher than the forward voltage of one of the diodes 25, the respective diode 25 starts to conduct, so that the second resistor 24 is connected parallel to first resistor 22 of the controllable signal processor 14. Accordingly, the cut-off frequency of the signal processor 14 is increased.

FIGS. 4*a*, 4*b* and 5*a*, 5*b* illustrate the operation of the circuit 3 with reference to schematic graphs of the pre-filtered operating voltage 26 and the dimming signal 12.

Figure 4A:
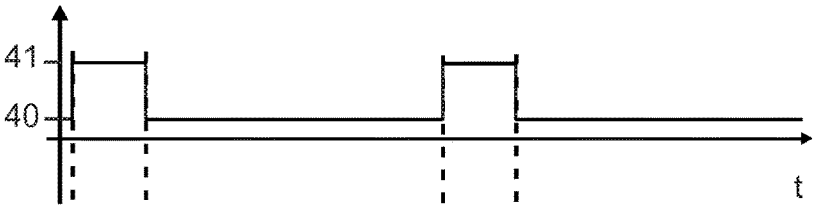
FIGS. 4*a* and 4*b* show schematic graphs of a dimming operation of a phase-cut-dimmer and the corresponding operating voltage.
Figure 4B:
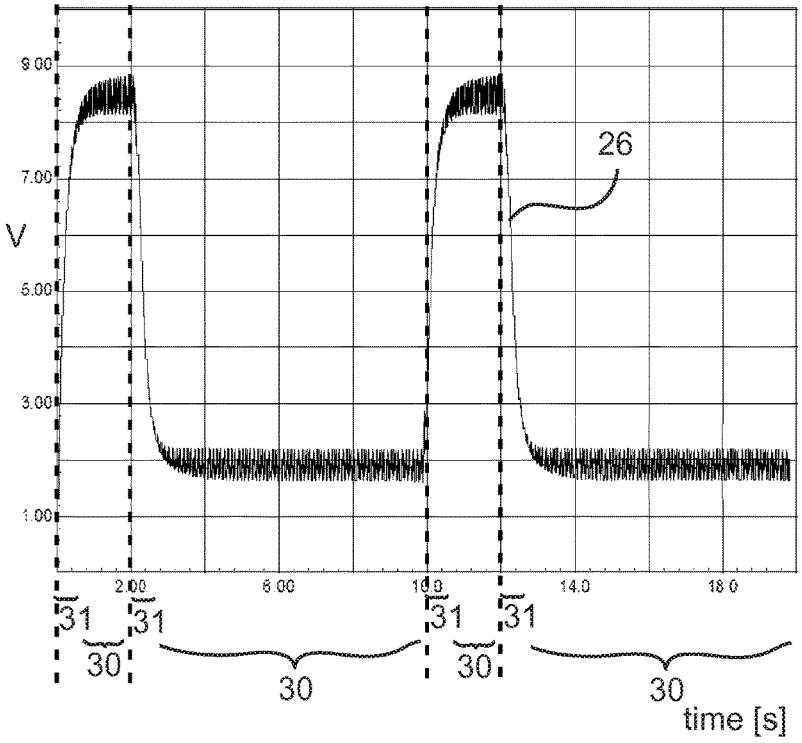
Figure 5A:
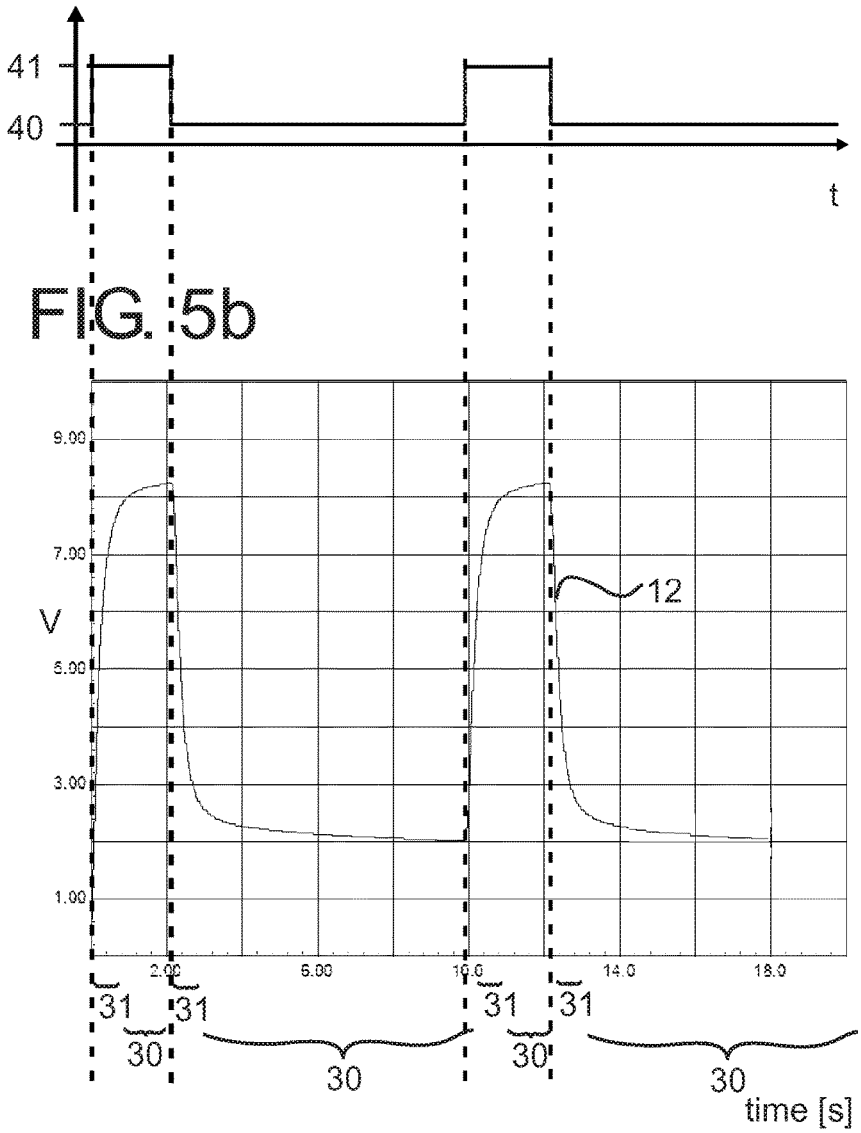

FIGS. 4*a* and 5*a* schematically show the setting of the phase-cut dimmer 7 over time. Here, a user controls the dimmer 7 between a first dim setting 40 and a second dim setting 41. FIG. 4*b* shows the response in the pre-filtered operating voltage 26 at the output of the first low-pass filter 13. As can be seen, the operating voltage 26 varies between approximately 2 V and 8.5 V according to the first and second dim setting 40, 41, respectively. Furthermore, FIG. 4*b* shows that even after the first low-pass filter 13, a low-frequency noise signal is still present, as can be seen from the ripple in the graph. The circuit 3 according to the present embodiment as described above provides that when the operating voltage 26 shows a large variation, such as when the dim setting is changed between said first and second setting 40, 41 and as indicated in FIGS. 4*b* and 5*b* by the dotted lines, the signal processor 14 is brought into the dimming mode 31, providing that the cut-off frequency of the signal processor 14 is increased and thus resulting in a small phase-shift or time lag. As mentioned above, the high gradient in the operating voltage 26 causes a voltage between the pre-filtered operating voltage 26 and the dimming signal 14, so that the cut-off frequency of the signal processor 14 is increased. As can be seen from the corresponding graph in FIG. 5*b*, the dimming signal 12 "follows" the change of the dim setting instantly, i.e. within acceptable time.

When the rectified operating voltage 26 does not show a high gradient, i.e. when the voltage between operating voltage 26 and dimming signal 14 is lower than the forward voltage of the diodes 25, the signal processor 14 is brought into the noise suppression mode 30, i.e. providing the low first cut-off frequency to suppress the noise signal.

As can be seen from FIG. 5*b*, noise ripple, present in the operating voltage 26 according to FIG. 4*b*, is removed while at the same time, the dimming signal 12 follows the operating voltage 26 instantly when a high variation in the operating voltage 26 is determined. The signal processor 14 thus provides a non-linear filtering behaviour in dependence of the variation of the voltage 26.

Figure 6:
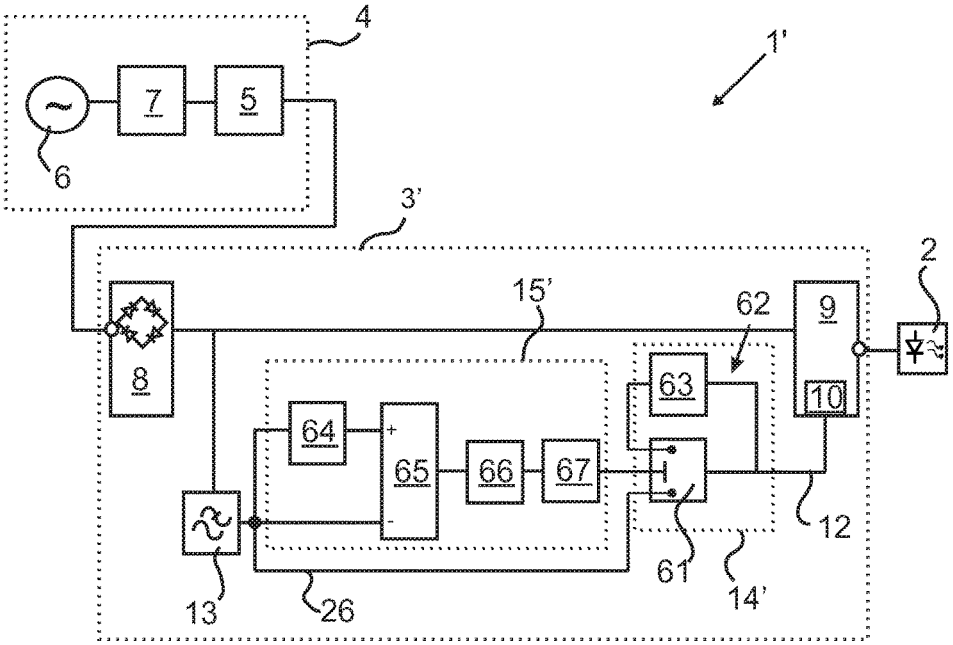
FIG. 6 shows a schematic circuit diagram of a second embodiment of a lighting system comprising an LED lamp with a circuit arrangement for controlling the brightness thereof and FIG. 7 shows a graph of the operation of the embodiment according to FIG. 6.

A second embodiment of a LED lamp 1' with a circuit arrangement 3' according to the invention is schematically shown in FIG. 6. The present embodiment corresponds to the embodiment, explained above with reference to the preceding figures, with the exception of the setup of the controllable signal processor 14' and the control device 15'. According to the above, the signal processor 14' also provides an operation in the noise suppression mode 30 and the dimming mode 31. However, according to the embodiment of FIG. 6, the signal processor 14' comprises a controllable switching device 61, e.g. a MOSFET switch, to set the dimming signal 12 either to the pre-filtered operating voltage 26 or to keep the dimming signal 12 constant, i.e. to "freeze" the dimming signal 12. To provide "freezing", the signal processor 14' comprises a sampling circuit 62, which sampling circuit 62 is connected to receive the dimming signal 12 and to provide said dimming signal 12 to an output delay unit 63. When the switching device 61 sets the signal processor 14' to the noise reduction mode 30, the delayed feedback of the dimming signal 12 is fed back to the switching device 61 and provides that the dimming signal 12 is maintained at a constant value.

The switching device 61 is controlled by control unit 15', which in the present embodiment comprises an input delay unit 64, which receives the pre-filtered operating voltage 26 and provides a reference signal, corresponding to the operating voltage, delayed by a delay time of less than 1 second. The delayed operating voltage is then compared with the non-delayed operating voltage 26 in a comparator 65 to determine a variation in the operating voltage. Next, the absolute value of the variation is determined by an absolute value circuit 66, i.e. using an OPAMP-circuit. The absolute value of the variation is then compared with a threshold of, according to the present embodiment equal to or less than 1 V, in a threshold circuit 67. When the absolute variation is higher than the defined threshold of equal to or less than 1

V, the switching device 61 is set to the dimming mode 31 and supplies the pre-filtered operating voltage 26 to the control port 10 of the driver unit 9. The dimming signal 14 then corresponds to the pre-filtered operating voltage 26. In case the absolute variation is lower than the threshold, the switching device 61 activates the sampling circuit 62, so that the dimming signal 12 is maintained constant at its previously set value.

Figure 7:
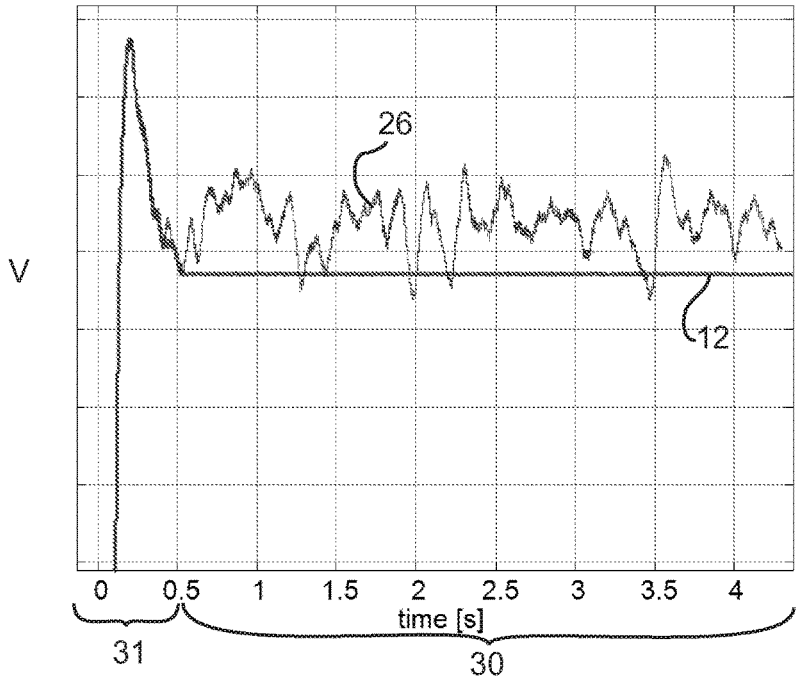

The operation of the circuit arrangement 3' according to FIG. 6 is shown in a schematic graph in a FIG. 7. The graph shows the pre-filtered operating voltage 26 together with the dimming signal 12 over time. As can be seen from FIG. 7, noise, present in the operating voltage 26 is removed from dimming signal 12 by freezing the dimming signal 12 in the noise suppression mode 30, i.e. when the variation of the operating voltage 26 is below the predefined threshold value. In case the variation of the operating voltage 26 is higher than the threshold value, i.e. in the dimming mode 31, the dimming signal 12 corresponds to the operating voltage 26, as shown in FIG. 7, so that a user operation, i.e. a change in the dim setting of the phase-cut dimmer 7, is instantly shown in a corresponding change of the brightness of the LED unit 2. Both, the signal processor 14' and/or the control unit 15' may alternatively be at least partly implementing using a microcontroller with a corresponding programming.

Other variations to the disclosed embodiments can be understood and effected by those skilled in the art in practicing the claimed invention from a study of the drawings, the disclosure and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A circuit arrangement for controlling the brightness of at least one LED unit, the circuit arrangement comprising:

an input for receiving a phase-cut operating voltage having an amplitude from a power supply;

a signal processor, connected with said input and adapted to provide a dimming signal for said at least one LED unit from said phase-cut operating voltage, said signal processor being configured to operate at least in a noise suppression mode and a dimming mode; and a control device, connected with said signal processor and configured to set the mode of said signal processor in dependence of the variation in said phase-cut operating voltage, and to determine said variation by comparing said amplitude of said phase-cut operating voltage with a reference signal to determine whether the amplitude of said phase-cut operating voltage exceeds a predetermined threshold value, wherein said control device comprises a switchable control circuit comprising a resistor in series with a diode arrangement of two parallel connected opposing diodes, to provide an alternative current path through the resistor so that a cut-off frequency of the signal processor is set to a second cut-off frequency;

wherein said reference signal corresponds to said dimming signal, wherein the predetermined threshold value is at least as high as a forward voltage of one of the opposing diodes.

2. The circuit arrangement according to claim 1, wherein a first low-pass filter is connected between said input and said signal processor.

3. The circuit arrangement according to claim 2, wherein said signal processor comprises a second low-pass filter to provide said dimming signal from said phase-cut operating voltage and wherein said second low-pass filter is operated in said noise suppression mode with a first cut-off frequency and in said dimming mode with a second cut-off frequency, said first cut-off frequency being lower than said second cut-off frequency.

4. The circuit arrangement according to claim 3, wherein the second low-pass filter is an RC low-pass filter circuit, comprising at least a resistive and a capacitive path and wherein said switchable control circuit is arranged parallel to said resistive path of said filter circuit to control the cut-off frequency of said RC filter circuit.

5. LED lamp comprising at least a circuit arrangement according to claim 1 and one or more LED units, connected with said circuit arrangement.

6. A lighting system comprising a power supply adapted to provide a phase-cut operating voltage and one or more LED lamps according to claim 5, connected to said power supply.

7. The circuit arrangement according to claim 2, wherein a second low-pass filter is connected between said input and said signal processor.

8. A circuit arrangement for controlling the brightness of at least one LED unit, the circuit comprising:

an input for receiving a phase-cut operating voltage from a power supply, a signal processor, connected with said input and adapted to provide a dimming signal for said at least one LED unit from said phase-cut operating voltage, said signal processor being configured to operate at least in a noise suppression mode and a dimming mode and a control device, connected with said signal processor and configured to set the mode of said signal processor in dependence of the variation in said phase-cut operating voltage, and to determine said variation by comparing said phase-cut operating voltage with a reference signal;

wherein said reference signal corresponds to said dimming signal, wherein said signal processor comprises a sampling circuit, which is adapted upon activation to sample an amplitude of said dimming signal, so that said dimming signal corresponds to said sampled amplitude until said sampling circuit is deactivated.

9. The circuit arrangement according to claim 8, wherein said control device comprises a delay unit, adapted to receive said phase-cut operating voltage and to provide said reference signal, corresponding to said phase-cut operating voltage with a predefined delay time.

10. The circuit arrangement according to claim 8, wherein the signal processor is configured so that said sampling circuit is activated in said noise suppression mode.

11. The circuit arrangement according to claim 10, wherein the signal processor is configured so that said sampling circuit is deactivated in said dimming mode.

12. The circuit arrangement according to claim 11, further comprising a driver unit, connected with said input and adapted to provide an operating current to set at least one LED unit, wherein said driver unit is further connected with said signal processor to set the operating current corresponding to said dimming signal.

13. A method of controlling the brightness of at least one LED unit with a circuit arrangement comprising an input for receiving a phase-cut operating voltage having an amplitude from a power supply, and a signal processor, connected with said input and being adapted to provide a dimming signal from said phase-cut operating voltage in at least a noise suppression mode and a dimming mode, in which the mode of said signal processor is set in dependence of the variation in said phase-cut operating voltage and said variation being determined by comparing said amplitude of said phase-cut operating voltage with a reference signal corresponding to said dimming signal to determine whether the amplitude of said phase-cut operating voltage exceeds a predetermined threshold value, and wherein an alternative current path is provided so that a cut-off frequency of the signal processor is set to a second cut-off frequency, wherein the brightness of the at least one LED unit is controlled according to the dimming signal.

14. A circuit arrangement for controlling the brightness of at least one LED unit, the circuit comprising:

an input for receiving a phase-cut operating voltage having an amplitude from a power supply;

a signal processor connected with said input and adapted to provide a dimming signal for said at least one LED unit from said phase-cut operating voltage, said signal processor being configured to operate at least in a noise suppression mode and a dimming mode;

a first low-pass filter connected between said input and said signal processor, wherein the signal processor comprises a second low-pass filter to provide said dimming signal from said phase-cut operating voltage, the signal processor providing a first current path; and a control device is arranged parallel to said signal processor and configured to set the mode of said signal processor in dependence of the variation in said phase-cut operating voltage, and to determine said variation by comparing said amplitude of said phase-cut operating voltage with a reference signal to determine whether the amplitude of said phase-cut operating voltage exceeds a predetermined threshold value, the control device providing an alternative current path to provide an alternative current path so that a cut-off frequency of the signal processor is set to a second cut-off frequency, wherein the brightness of the at least one LED unit is controlled according to the dimming signal.

* * * * *